United States Patent [19]

Riollet et al.

[11] 4,214,452

[45] Jul. 29, 1980

[54] EXHAUST DEVICE FOR A CONDENSABLE-FLUID AXIAL-FLOW TURBINE

[75] Inventors: Gilbert Riollet; Gerard Franconville, both of Paris, France

[73] Assignee: Alsthom-Atlantique, Paris, France

[21] Appl. No.: 932,383

[22] Filed: Aug. 9, 1978

[30] Foreign Application Priority Data

Aug. 25, 1977 [FR] France ..... 77 25939

[51] Int. Cl.[2] ..... F01D 25/30

[52] U.S. Cl. ..... 60/697; 415/DIG.1

[58] Field of Search ..... 60/685, 686, 693, 694, 60/697; 415/219 R, 121 A, DIG. 1

[56] References Cited

U.S. PATENT DOCUMENTS

| | | | |
|---|---|---|---|
| 1,276,154 | 8/1918 | Zoelly | 60/697 |
| 1,814,629 | 7/1931 | Hanzlik | 60/694 |

FOREIGN PATENT DOCUMENTS 993476 5/1965 United Kingdom .

*Primary Examiner*—Allen M. Ostrager
*Assistant Examiner*—Stephen F. Husar
*Attorney, Agent, or Firm*—Sughrue, Rothwell, Mion, Zinn and Macpeak

[57] ABSTRACT

An exhaust device for a condensable-fluid axial-flow turbine, comprising an annular diffuser with an axial input situated at the output of the last stage of the turbine and a substantially radial output leading to a condenser which is divided into two zones, in one of which the pressure is lower than in the other, the outer wall of the diffuser with respect to the input flow into the duct having a circumferential suction slot which removes a fraction of the flow in the diffuser towards the lower-pressure part of the condenser, said wall further having a shape such that the pressure gradient measured at its surface in the flow direction is negative or zero at all points.

9 Claims, 4 Drawing Figures

EXHAUST DEVICE FOR A CONDENSABLE-FLUID AXIAL-FLOW TURBINE

FIELD OF THE INVENTION

The present invention relates to an exhaust device for a condensable-fluid axial-flow turbine.

In particular, the invention relates to annular diffusers with an axial input and a substantially radial output installed at the exhaust of a turbine to guide the flow which leaves the last expansion stage of the turbine towards the condenser.

BACKGROUND OF THE INVENTION

In known arrangements for turbine diffusers with axial inputs and radial outputs, the fluid is exhausted through a toroidal duct whose axial cross-section is curved and which generally has internal fluid-guiding walls. The diffuser has two functions: firstly to deflect the fluid and secondly to recompress the fluid. Present diffusers have poor aerodynamic qualities due to a recompression gradient on the convex surfaces of the guide walls; this breaks down the fluid flow. Thus, the speed and direction of flow at the output of these diffusers is heterogeneous. This heterogeneous flow of the fluid at the output of the diffuser also greatly hinders proper operation of the downstream connection part whose losses are increased in relation to those in an arrangement where the flow is homogeneous.

SUMMARY OF THE INVENTION

The present invention aims to mitigate these disadvantages by producing an exhaust unit assembly for reducing the energy losses at the output of a condensable-fluid turbine. The present invention provides an exhaust device for a condensable fluid axial-flow turbine, the exhaust device comprising an annular diffuser with an axial input situated at the output of the last stage of the turbine and a substantially radial output leading to a condenser which is divided into two zones, in one of which the pressure is lower than in the other, the outer wall of the diffuser with respect to the input flow into the duct having a circumferential suction slot which removes a fraction of the flow in the diffuser towards the lower pressure part of the condenser, said wall further having a shape such that the pressure gradient measured at its surface in the flow direction is negative or zero at all points.

The diffuser is preferably divided into a plurality of component diffusers by hollow partitions which are substantially parallel to the innermost and outermost walls of the diffuser, the outer wall of at least one of said partitions having a circumferential suction slot which removes a fraction of the flow in the diffuser towards the lower pressure part of the condenser, said wall further having a shape such that the pressure gradient measured at its surface in the flow direction is negative or zero at all points.

The cross-section, in an axial plane, of the outer wall of the, or each, diffuser is preferably convex immediately upstream from the circumferential slot and is preferably concave immediately downstream from said slot, convex and concave being with respect to the main flow patch.

The part of the outer wall of the or each diffuser situated upstream from its circumferential suction slot extends into the adjacent chamber following a very rounded convex curve.

Advantageously, the local speed of the fluid flow upstream from the or each suction slot remains less than 1.3 times the average input speed into the corresponding diffuser.

Preferably, the flow removed by each circumferential slot lies between 4 and 12% of the flow in the component diffuser corresponding to the said slot.

Two embodiments of the invention are described hereinbelow with reference to the accompanying drawings

DESCRIPTION OF THE PREFERRED EMBODIMENTS

Figure 1:
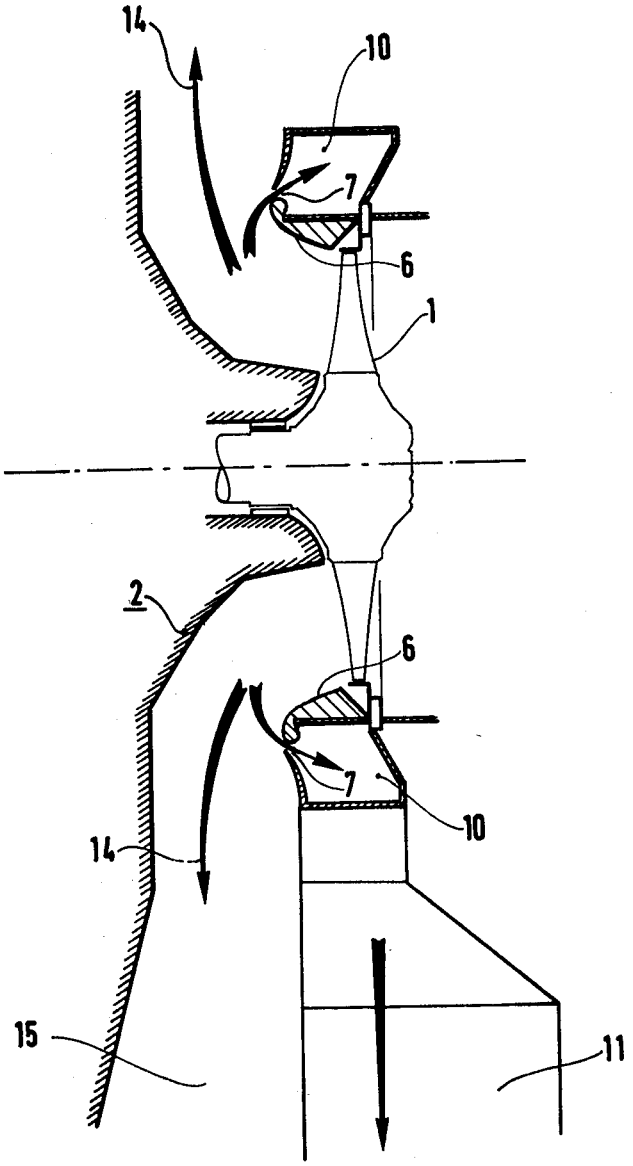
FIG. 1 is an axial cross-section of the end of an axial-flow turbine exhaust in accordance with the invention in the case of a single-duct diffuser.

FIG. 1 shows the final low-pressure wheel 1 of an axial-flow steam turbine. The output cross-section of this wheel is annular and is connected to a cylindrical surface by a toroidal diffuser whose axial cross-section is curved.

There is a circumferential suction slot 7 in the outer wall 6 of the diffuser 2 (i.e. in the wall 6 which is on the outside of the inlet flow in the duct of the diffuser 2). The circumferential slot 7 connects the diffuser duct to an annular chamber 10 which is itself connected by a connection casing 11 to the lower-pressure part of a two pressure condenser, (not shown). Such a condenser is known; it comprises two condensation zones which are separated by a wall through which the same nest of cooling water tubes passes. One of these zones is at a lower pressure than the other.

Thus, a part of the flow which escapes from the final wheel 1 of the axial-flow turbine is sucked through the slot 7 into the chamber 10 and thence through the casing 11 towards the lower-pressure zone of the condenser, while the main part of the exhaust flow leaves in the direction of the arrow 14 towards a casing 15 which leads to the higher-pressure zone of the condenser.

Figure 2:
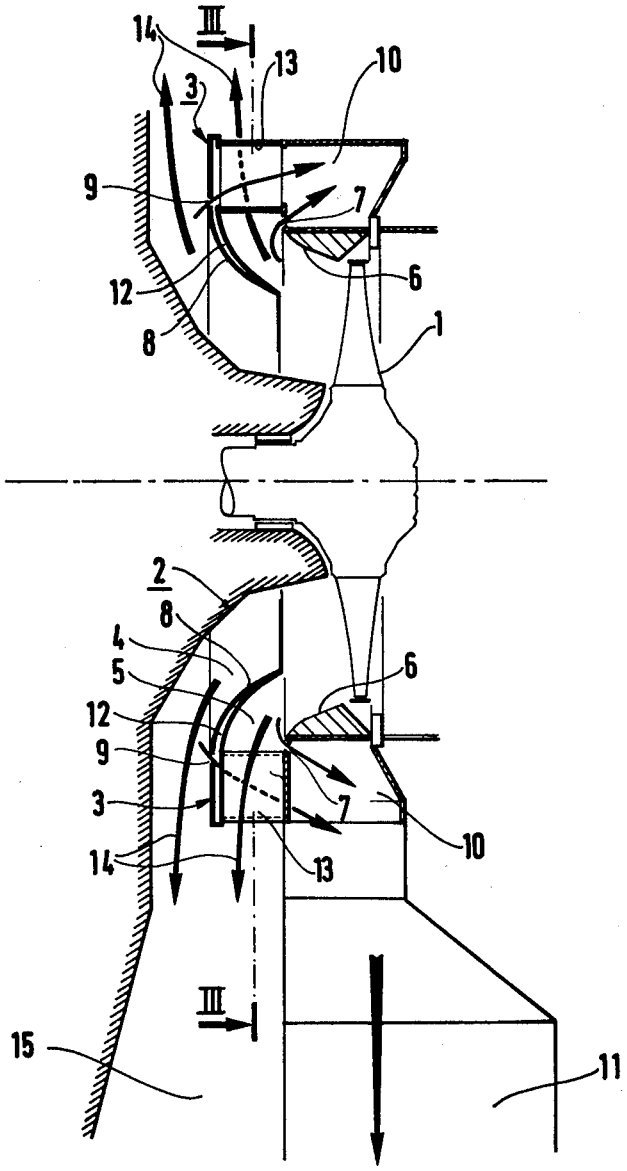
FIG. 2 is an axial cross-section of the end of an axial-flow turbine exhaust in accordance with the invention in the case of a multiple-duct diffuser.
Figure 3:
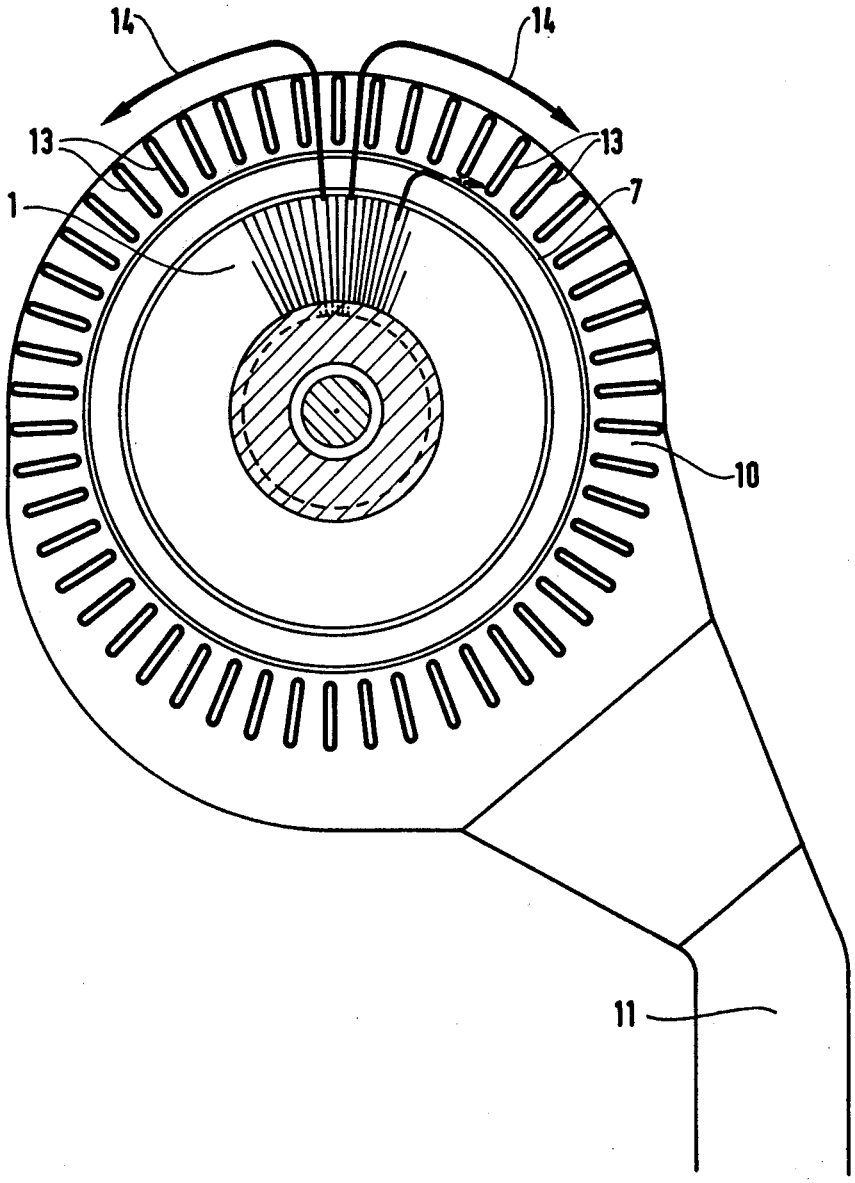
FIG. 3 is a cross-section through III-III in FIG. 2.

FIGS. 2 and 3, in which like elements bear like numeral designations, show special configurations of diffusers having several ducts. Inside the diffuser 2, there is a partition 3 (extending over a surface of revolution) which divides the diffuser into two component diffusers 4 and 5. This partition reduces the transversal pressure gradients. The diffuser 5 is identical to the one described in FIG. 1. The partition 3 has a circumferential suction slot 9 in its convex wall 8. The circumferential slot 9 connects the duct of the other component diffuser 4 to the annular chamber 10 by means of hollow struts 13 designed to support the partition 3.

Thus, in each of the diffusers 4 and 5, a fraction of the main flow is removed through the slots 7 and 9 towards the lower-pressure part of the condenser.

FIG. 3 shows the way in which the struts 13 are arranged. They are radially disposed in the low-speed part of the flow and are shaped and positioned therein so as not to cause high losses.

Figure 4:
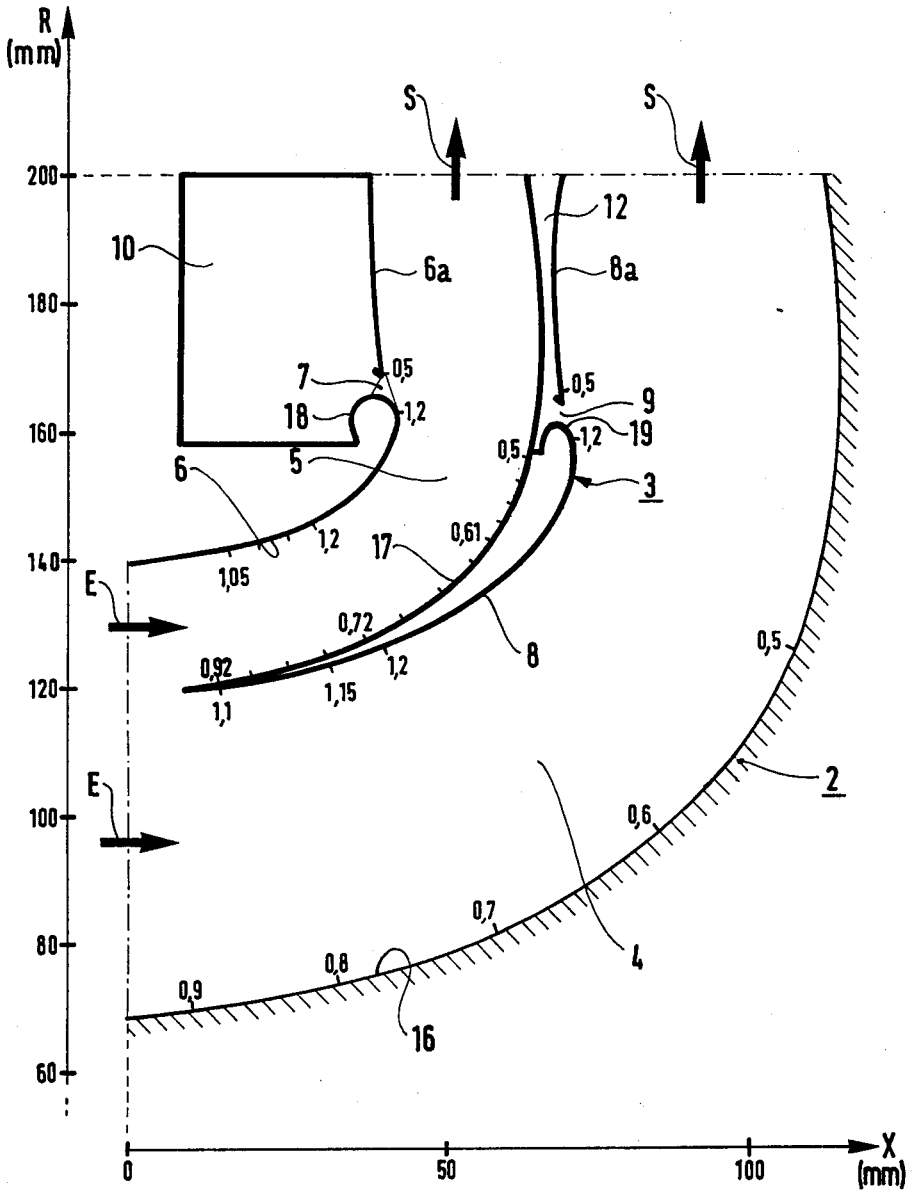
FIG. 4 is a cross-section which shows an example of the profiles of the walls of the diffuser shown in FIG. 2 but on a larger scale.

FIG. 4 is an enlarged axial half cross-section view of the diffuser 2. This figure shows the profiles of the walls. The arrows E show the substantially axial input flow of the fluid into the diffuser and the arrows S show the substantially radial output flow of the fluid.

The diffuser has an outer wall 6 on the radial outside of the input flow and an inner wall 16 on the radial inside of the input flow. This diffuser is divided into the two component diffusers 4 and 5 by the internal partition 3. This partition is hollow and its interior 12 is connected to the duct 4 by the circumferential suction slot 9 in its convex wall 8. Similarly, the outer wall 6 is pierced by the circumferential suction slot 7 which connects the duct 5 to the annular chamber 10. This figure shows the profiles of the walls. Each of the outer walls 6 and 8 to the respective input flows of the component diffusers has an axial cross-section which is convex immediately upstream from its suction slot ( see 6*a* and 8*a*). Further, the portion of the outer walls 6 and 8 situated upstream from the circumferential slots, 7, 9, respectively, extends into the suction chamber in a very rounded curve 18 and 19.

The graduations on the figure show the local speed in terms of the average fluid input speed flow over the convex part of the outer walls 6 and 8 situated upstream from the circumferential suction slots 7 and 9. This speed accelerates up to 1.2 times the input speed. The speed is then constant up to the suction slot. After the suction slot, the speed is constant and equal to the output speed. On the concave innermost wall 16 and on the concave wall 17 of the partition 3, the speed is continuously reduced from the average input speed to half the speed. Boundary limit suction can be effected on the walls 16 and 17. Thus, the pressure gradient along the outer walls 6 and 8 is negative from the input of the fluid into the diffuser up to the points of these walls where the speed reaches 1.2 times the input speed. It is then zero up to the respective suction slots where the fluid is then again compressed, and after the slots the pressure gradient is again zero up to the output.

In contrast to the case of axial-flow diffusers in which the speed of the fluid along the walls can never exceed the fluid input speed, here, it is necessary to accelerate along the convex walls so as to deviate the fluid. The profiles of the ducts 4 and 5 and the number of ducts limit the excess speed to keep it compatible with the suction capabilities of the cold or lower-pressure zone of the two-pressure condenser.

In the example of FIG. 4, the speed along the convex outer walls 6 and 8 does not exceed 1.2 times the input speed; it is advantageous for it not to exceed 1.3 times this speed.

Advantageously, the flow removed by each circumferential slot (7 and 9) lies between 4 and 12% of the flow in the component diffuser (5 and 4 ) which corresponds to said slot.

We claim:

1. An exhaust device for a condensable-fluid axial-flow turbine leading to a multi-zone condenser, said exhaust device comprising an annular diffuser with an axial input open to the output of the last stage of the turbine and a substantially radial output leading to the condenser which is divided into two zones in one of which the pressure is lower than in the other, the radially outer wall of the diffuser with respect to the input flow into the duct having a circumferential suction slot which connects to the lower pressure port of the condenser to remove a fraction of the flow in the diffuser towards the lower-pressure part of the condenser and said radially outer wall further having a shape such that the pressure gradient measured at its surface in the flow direction is negative or zero at all points.

2. An exhaust device according to claim 1, wherein the cross-section, in an axial plane, of the outer wall of the diffuser is convex immediately upstream from the circumferential slot and is concave immediately downstream from said slot with respect to the main flow path which it faces.

3. An exhaust device according to claim 1, wherein that part of the outer wall of the diffuser situated upstream from its circumferential suction slot extends into the adjacent chamber following a very rounded convex curve.

4. An exhaust device according to claim 1, wherein the local speed of the fluid flow upstream from the suction slot remains less than 1.3 times the average input speed into the diffuser.

5. An exhaust device according to claim 1, wherein the flow removed by the suction slot lies between 4 and 12% of the flow in the diffuser.

6. An exhaust device according to claim 1, wherein the diffuser is divided into a plurality of component diffusers by hollow partitions which are substantially parallel to the innermost and outermost walls of the diffuser and the radially outer wall of at least one of said partitions carrying said circumferential suction slot to remove a fraction of the flow in the diffuser to the lower pressure part of the condenser with said partition wall having said shape such that the pressure gradient measured at its surface in the flow direction is negative or zero at all points.

7. An exhaust device according to claim 6, wherein the cross-section, in an axial plane, of the outer wall of the component diffuser is convex immediately upstream from the circumferential slot, and is concave immediately downstream from said slot with respect to the main flow path which it faces.

8. An exhaust device according to claim 6, wherein the local speed of the fluid flow upstream from the suction slot remains less than 1.3 times the average input speed into the diffuser.

9. An exhaust device according to claim 6, wherein the flow removed by the suction slot lies between 4 and 12% of the flow in the diffuser.

* * * * *